US008418642B2

(12) United States Patent
Vosburgh

(10) Patent No.: US 8,418,642 B2
(45) Date of Patent: Apr. 16, 2013

(54) UNMANNED SUBMERSIBLE VEHICLES AND METHODS FOR OPERATING THE SAME IN A BODY OF LIQUID

(75) Inventor: Frederick Vosburgh, Durham, NC (US)

(73) Assignee: iRobot Corporation, Bedford, MA (US)

( * ) Notice: Subject to any disclaimer, the term of this patent is extended or adjusted under 35 U.S.C. 154(b) by 484 days.

(21) Appl. No.: 12/437,181

(22) Filed: May 7, 2009

(65) Prior Publication Data

US 2012/0137949 A1 Jun. 7, 2012

Related U.S. Application Data

(60) Provisional application No. 61/051,836, filed on May 9, 2008.

(51) Int. Cl.

| | |
|---|---|
| ***B63G 8/08*** | (2006.01) |
| ***B63G 8/14*** | (2006.01) |
| ***B63G 8/18*** | (2006.01) |
| ***B63G 8/22*** | (2006.01) |
| ***B63G 8/38*** | (2006.01) |
| ***B63G 8/39*** | (2006.01) |
| ***H01Q 1/04*** | (2006.01) |
| ***H01Q 1/34*** | (2006.01) |

(52) U.S. Cl.

USPC ..... 114/312; 114/328; 114/330; 114/331; 114/337; 343/709; 367/131

(58) Field of Classification Search ..... 114/312, 114/328, 330–333, 337, 338; 343/709, 710; 367/2–6, 131–134; 340/850, 851

See application file for complete search history.

(56) References Cited

U.S. PATENT DOCUMENTS 3,158,865 A * 11/1964 McCorkle ..... 343/709
3,258,595 A * 6/1966 Galante ..... 398/112

(Continued)

FOREIGN PATENT DOCUMENTS

DE 4440150 A1 * 5/1996

OTHER PUBLICATIONS

U.S. Appl. No. 12/315,760, filed Dec. 5, 2008, titled "Submersible Vehicles and Methods for Propelling and/or Powering the Same in an Underwater Environment," 30 pages.

(Continued)

*Primary Examiner* — Ajay Vasudeva

(74) *Attorney, Agent, or Firm* — Myers Bigel Sibley & Sajovec

(57) ABSTRACT

An unmanned submersible vehicle for use in a body of liquid having a top surface and in air overlying the top surface includes a hull, an integral antenna, and an antenna positioning system. The hull has first and second opposed ends. The hull includes a first hull portion adjacent the first end and a second hull portion adjacent the second end. The antenna is disposed within the first hull portion and/or is mounted on the first hull portion. The antenna positioning system is configured to reorient the hull from a transit position to a signal position. When the hull is in the signal position: the first hull portion and the antenna are disposed above the second hull portion a greater vertical distance than when the hull is in the transit position; the first hull portion and the antenna are disposed above the top surface and in the air while at least the second hull portion remains submerged in the body of liquid; and the antenna is operative to emit signals through the air above the top surface and/or to receive signals through the air above the top surface.

30 Claims, 5 Drawing Sheets

U.S. PATENT DOCUMENTS

| | | | | |
|---|---|---|---|---|
| 3,946,391 | A * | 3/1976 | Cuckler et al. | 343/709 |
| 4,189,786 | A | 2/1980 | Adler | |
| 4,203,160 | A * | 5/1980 | Doherty | 367/2 |
| 4,543,582 | A * | 9/1985 | Hellwege et al. | 343/710 |
| 4,649,744 | A * | 3/1987 | Cotillier | 73/170.34 |
| 5,132,696 | A * | 7/1992 | Cobb | 343/709 |
| 6,058,071 | A | 5/2000 | Woodall et al. | |
| 6,254,445 | B1 | 7/2001 | Jones | |
| 6,392,606 | B1 * | 5/2002 | French et al. | 343/709 |
| 6,711,095 | B1 | 3/2004 | Daniels | |
| 6,738,314 | B1 | 5/2004 | Teeter et al. | |
| 6,813,218 | B1 | 11/2004 | Antonelli et al. | |
| 6,899,583 | B2 | 5/2005 | Barden | |
| 6,961,657 | B1 | 11/2005 | Wernli et al. | |
| 7,496,000 | B2 | 2/2009 | Vosburgh et al. | |
| 2008/0041293 | A1 * | 2/2008 | Diorio et al. | 114/312 |

OTHER PUBLICATIONS

U.S. Appl. No. 12/408,177, filed Mar. 20, 2009, titled "Submersible Vehicles and Methods for Transiting the Same in a Body of Liquid," 38 pages.

* cited by examiner

UNMANNED SUBMERSIBLE VEHICLES AND METHODS FOR OPERATING THE SAME IN A BODY OF LIQUID

RELATED APPLICATION(S)

This application claims the benefit of and priority from U.S. Provisional Patent Application Ser. No. 61/051,836, filed May 9, 2008, the disclosure of which is incorporated herein by reference in its entirety.

STATEMENT OF GOVERNMENT SUPPORT

This invention was made with support under Small Business Innovation Research (SBIR) Contract No. N00024-07-C-4108 awarded by the United States Navy. The Government has certain rights in the invention.

FIELD OF THE INVENTION

The present invention relates to submersible vehicles and methods for operating the same.

BACKGROUND OF THE INVENTION

Monitoring of the oceans and other bodies of water for purposes of scientific research, national defense, or commercial development is becoming increasingly automated to reduce costs. For example, unmanned underwater vehicles (UUV) have emerged as key tools in the offshore engineering industry. Considerable investment is being made by nations around the world to develop UUVs for national or homeland defense. With the increasing requirement for persistent intelligence, surveillance and reconnaissance (ISR) operations in areas where access is denied or where ISR is otherwise desirably clandestine, UUVs will be increasingly put to use. Use of UUVs to service devices historically tended by submarines, deep submersible vehicles and divers will substantially reduce cost and risk to the operators. So, it can be seen, persistent ISR and other activities in problematic areas drive the need for means of sensing and communicating that do not require human intervention or costly engineering systems.

Certain warfare strategies require pervasive connectivity, including for intelligence preparation of a battle space. The strategy for preparation, particularly during the lead up to conflict in denied areas, may rely increasingly on UUVs that can gather and relay data to remote users.

SUMMARY OF THE INVENTION

According to embodiments of the present invention, an unmanned submersible vehicle for use in a body of liquid having a top surface and in air overlying the top surface includes a hull, an integral antenna, and an antenna positioning system. The hull has first and second opposed ends. The hull includes a first hull portion adjacent the first end and a second hull portion adjacent the second end. The antenna is disposed within the first hull portion and/or is mounted on the first hull portion. The antenna positioning system is configured to reorient the hull from a transit position to a signal position. When the hull is in the signal position: the first hull portion and the antenna are disposed above the second hull portion a greater vertical distance than when the hull is in the transit position; the first hull portion and the antenna are disposed above the top surface and in the air while at least the second hull portion remains submerged in the body of liquid; and the antenna is operative to emit signals through the air above the top surface and/or to receive signals through the air above the top surface.

According to embodiments of the present invention, a communications system for use in a body of liquid having a top surface and in air overlying the top surface includes a plurality of unmanned submersible vehicles adapted to be distributed in the body of liquid. Each of the vehicles includes a hull, an integrated antenna, an antenna positioning system, and a communications device. The hull has first and second opposed ends. The hull includes a first hull portion adjacent the first end and a second hull portion adjacent the second end. The antenna is disposed within the first hull portion and/or is mounted on the first hull portion. The antenna positioning system is configured to reorient the hull from a transit position to a signal position. When the hull is in the signal position: the first hull portion and the antenna are disposed above the second hull portion a greater vertical distance than when the hull is in the transit position; the first hull portion and the antenna are disposed above the top surface and in the air while at least the second hull portion remains submerged in the body of liquid; and the antenna is operative to emit signals through the air above the top surface and/or to receive signals through the air above the top surface. The communications device is operably connected to the antenna to generate and/or receive and process signals propagated through the air over the top surface.

According to method embodiments of the present invention, a method for operating an unmanned submersible vehicle includes providing an unmanned submersible vehicle. The vehicle includes a hull, an integral antenna, and an antenna positioning system. The hull has first and second opposed ends. The hull includes a first hull portion adjacent the first end and a second hull portion adjacent the second end. The antenna is disposed within the first hull portion and/or is mounted on the first hull portion. The antenna positioning system is configured to reorient the hull from a transit position to a signal position. The method further includes reorienting the hull from a transit position to a signal position using the antenna positioning system. When the hull is in the signal position: the first hull portion and the antenna are disposed above the second hull portion a greater vertical distance than when the hull is in the transit position; the first hull portion and the antenna are disposed above the top surface and in the air while at least the second hull portion remains submerged in the body of liquid; and the antenna is operative to emit signals through the air above the top surface and/or to receive signals through the air above the top surface.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
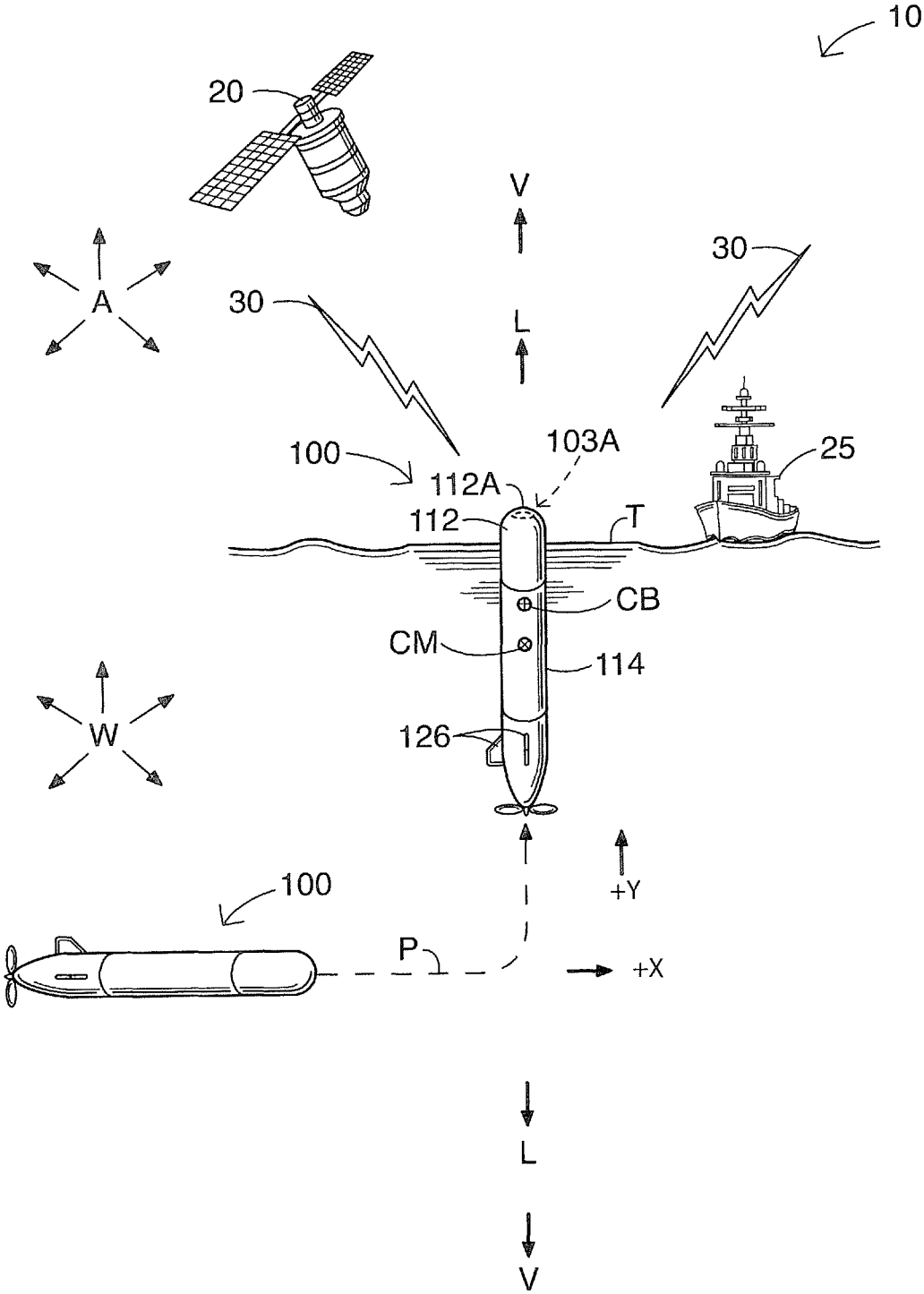
FIG. 1 is a schematic view of a system including an unmanned submersible vehicle according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the electronics device in use or operation in addition to the orientation depicted in the figures. For example, if the electronics device in the figures is turned over, elements described as "under" or "beneath" other elements or features would then be oriented "over" the other elements or features. Thus, the exemplary term "under" can encompass both an orientation of over and under. The electronics device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Well-known functions or constructions may not be described in detail for brevity and/or clarity.

As used herein, "submersible" means an object that is submersible in an intended liquid, such as water, and constructed such that electronic and other components thereof sensitive to the liquid are protected from contact with the surrounding liquid.

"Unmanned submersible vehicle" or "unmanned underwater vehicle" (UUV) means a submersible vehicle providing self-directed mobility, communicating, and/or sensing.

As discussed above, submerged UUVs can be particularly useful for persistent ISR. As with a submarine, a submerged UUV can be virtually undetectable, an advantage offset by isolation from useful airborne signals (e.g., for navigation and communication). Submerged UUVs typically rely, therefore, on sonar beacons. Sonar beacons or other aids to underwater navigation that require pre-deployment in denied areas are problematic unless they can be autonomously positioned. Periodic surfacing for GPS or other navigational updates carries a low probability of detection and, therefore, is suited to autonomous positioning. Complexity, cost and space constraints in UUVs militate against retractable antennas, so UUVs today typically use permanently extended antennas that are raised above the water during surfacing.

Permanently extended antennas present a number of problems beyond space, complexity and cost. These include inducing roll moments, fouling, breaking and increasing drag. The weight of an antenna and the stanchion that holds it aloft induce a rolling moment that can overcome the righting moment designed into the vehicle, causing the vehicle to change direction or the antenna to roll under the water. An extended antenna is prone to fouling by seaweed, fishing nets or other flotsam. It can also be damaged in handling on shipboard or if struck by an obstacle in the water. An extended antenna also creates drag that reduces speed and mission duration of these power-limited vehicles. Moreover, an extended antenna may render a UUV incompatible with existing launchers, as well as awkward to stow on board.

Unmanned submersible vehicles according to embodiments of the present invention can overcome or address the foregoing concerns while providing desired functionality in service. UUVs according to embodiments of the present invention can send and receive airborne signals. The UUVs may nonetheless be easy to store and launch, encounter minimal mission-shortening drag, and be robust against damage and fouling. The UUVs can reliably operate unattended in denied areas in support of intelligence preparation of a battle space and, thereby, net-centric warfare.

With reference to FIG. 1, an unmanned submersible vehicle (e.g., a water submersible vehicle) 100 according to embodiments of the present invention is shown therein in a body of liquid W such as water (e.g., an ocean, river or lake) having a top surface T and air A overlying the top surface T. According to some embodiments, the vehicle 100 is an unmanned underwater vehicle (UUV) or autonomous underwater vehicle (AUV). The vehicle 100 can be used for sensing, payload carrying or deploying, object servicing, and/or communicating in aquatic environments, for example.

The vehicle 100 may be used in a system 10 (FIG. 1) further including a remote unit such as a satellite 20, a waterborne boat or vessel 25, a fixed platform or the like. As discussed herein, the vehicle 100 may communicate with other components of the system (e.g., the satellite 20 and the vessel 25) by means of airborne communications signals 30. The signals 30 may additionally or alternatively include communications signals not intended for the vehicle 100 (e.g., intercepted signals) and/or signals other than communications signals sensed by the vehicle 100. The signals received by the vessel 100 may be used by the vehicle for navigation.

Figure 2:
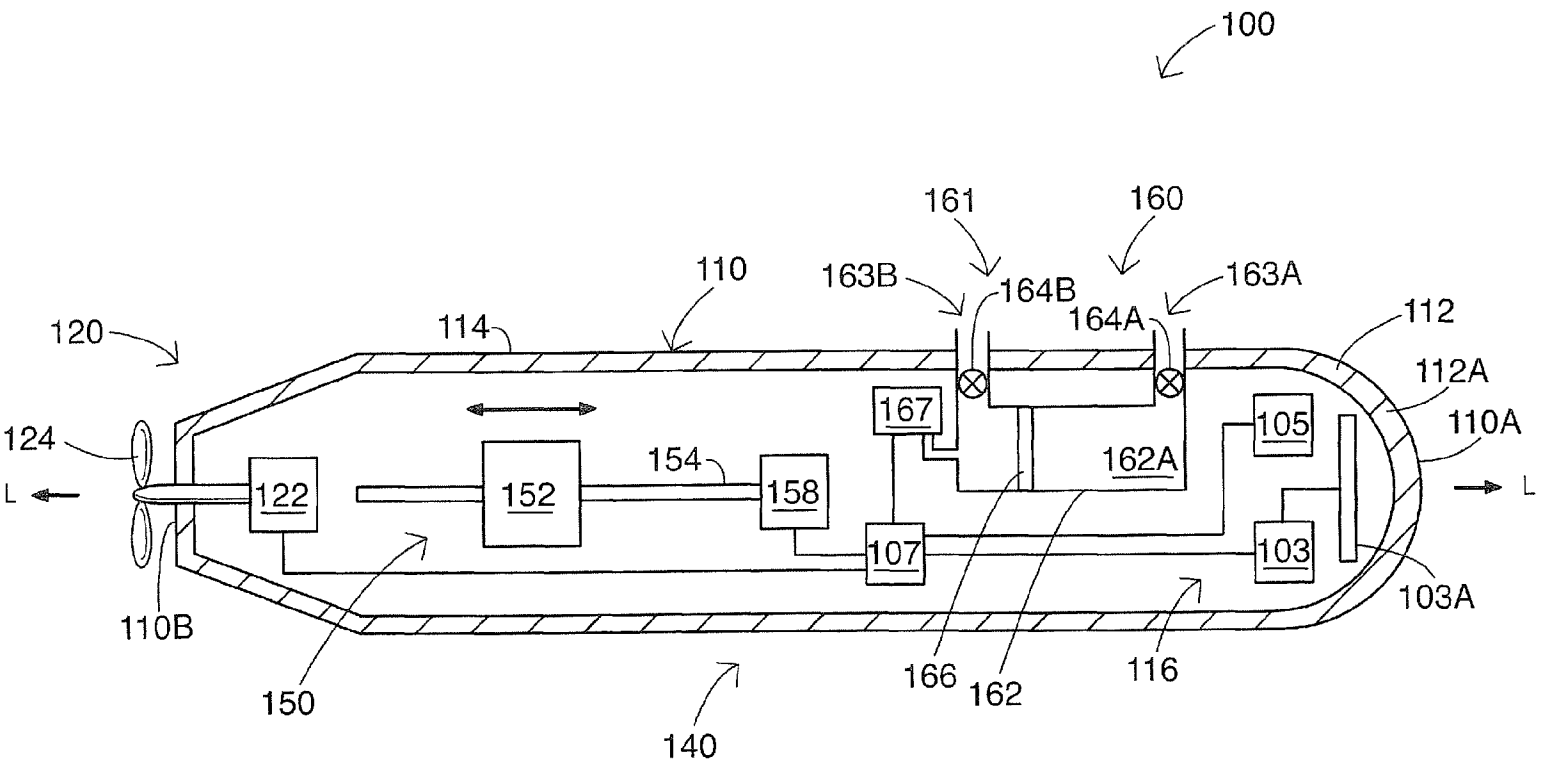
FIG. 2 is a schematic, cross-sectional view of the vehicle of FIG. 1.

With reference to FIG. 2, the vehicle 100 includes a hull 110, a communications device or module 103, an antenna 103A, a controller 107, a propulsion system 120, and an antenna positioning system 140. The vehicle 100 may include further components, systems or subcomponents such as a payload 105, a recharging system, and/or a power supply (e.g., a battery). The vehicle 100 has a center of buoyancy CB and a center of mass CM (FIG. 1).

The hull 110 has opposed forward and rearward ends 110A and 110B and a longitudinal axis L-L, extending through the ends 110A, 110B. A forward portion or section 112 of the hull 110 is disposed at or adjacent the forward end 110A and includes a nose 112A, which may have a streamlined, low drag profile. A rearward portion or section 114 of the hull 110 is disposed at or adjacent the rearward end 110B. The hull 110 defines an interior chamber 116. According to some embodiments, the chamber 116 is impervious to ingress of liquid from the body of water W except where ports are provided to selectively receive and/or expel the water (as discussed below).

The hull 110 may be formed of any suitable material. According to some embodiments, at least the nose 112A is formed of a material that does not significantly attenuate the signals 30.

The vehicle controller 107 controls the operation and interoperation of the various modules and systems. The vehicle controller 107 may include any suitable electronics (e.g., a microprocessor), software and/or firmware configured to provide the functionality described herein. While the controller 107 is illustrated herein schematically as a single module, the vehicle controller 107 may be functionally and physically distributed over multiple devices or subsystems.

The communications module 103 (which may be part of or connected to the vehicle controller 107, for example) is operably connected to the antenna 103A. The communications module 103 may include a radio, acoustic modem and/or light emitting device, for example.

The antenna 103A is mounted in the hull chamber 116 in the forward portion 112. According to some embodiments and as shown, the antenna 103A does not protrude from the hull 110, thereby permitting the hull 110 to retain a low drag profile. The antenna 103A can be any suitable type that can detect, receive and/or send an airborne signal, such as an electromagnetic signal of any wavelength. In some cases, the antenna 103A can detect and/or send a waterborne signal as well. Exemplary antenna types for the antenna 103A include cell phone, radio, intelligence gathering and radar antennas, for example. In some cases, the antenna 103A is an optical type (e.g., a photo detector or camera operable at visible, ultraviolet or infrared wavelength), acoustic type or radiation detecting type antenna. The antenna size, shape, mounting location and orientation are suitable for signals of interest.

The antenna positioning system 140 as illustrated includes a mass redistribution system 150, a buoyancy control system 160, and the propulsion system 120 (which may include a steering system 125). As will be appreciated from the description herein, these components and systems are exemplary and other embodiments of antenna positioning systems of the present invention may include different combinations of or modifications to these components and systems. In some embodiments, the antenna positioning system 140 can selectively alter the spatial relationship between the center of mass CM of the vehicle 100 and the center of buoyancy CB of the vehicle 100 in order to place the hull 110 in a substantially vertical orientation with the forward portion 112 above the rearward portion 114.

The mass redistribution system 150 is configured to selectively change the location of the center of mass CM of the vehicle with respect to the hull 110. In the illustrated embodiment, the mass redistribution system 150 includes a movable mass member 152, a track 154 and an actuator such as a mass drive motor 158. The mass member 152 is mounted on the track 154 to translate along the track 154 and along the longitudinal axis L-L. The drive motor 158 is operable to forcibly drive the mass member 152 along the track 154 into the desired position. In use, a controller (e.g., the controller 107) can control the drive motor 158 to reposition the mass member 152 and thereby relocate the center of mass CM. The mass redistribution system 150 is merely exemplary and other suitable mechanisms or systems may be used to selectively control and change the location of the center of mass CM.

The buoyancy control system 160 is configured to selectively change the location of the center of buoyancy C of the vehicle 100 and/or the net buoyancy of the vehicle 100. The buoyancy control system 160 may include one or more actuators operable by a controller (e.g., the controller 107) to selectively change the amount and center of the vehicle buoyancy.

In the illustrated embodiment, the buoyancy control system 160 includes a buoyancy engine 161 configured to selectively increase and decrease the net buoyancy of the vehicle 100. The buoyancy engine 161 includes a flood tank 162 in the hull 110. The flood tank 162 defines an enclosed chamber 162A having ports 163A, 163B to the exterior of the hull 110. The ports 163A, 163B are regulated by respective valves 164A, 164B. A piston 166 is mounted in the chamber 162A for movement fore and aft to change the respective volumes of the subchambers defined on either side thereof. An actuator such as a gas generator 167 may be provided to actively control the volume of gas or liquid in the tank 162. The gas generator 167 is fluidly connected to the chamber 162A. In some cases, the gas generator 167 can include a snorkel for inflow and/or outflow of air such as when the vehicle 100 is transiting proximate the water surface T or in a sensing orientation.

The gas generator 167 is operable to generate a displacement gas to push the piston 166 to purge or displace water from the reservoir 162A to thereby lower the density of the vehicle 100 and increase its buoyancy in the forward portion 112. The piston 166 can be reversible in order to thereafter decrease the buoyancy of the vehicle 100 in its forward portion 112. The valve 164A can be opened and closed as needed to draw in and expel water from the body of water W through the port 163A. The valve 164B can be opened and closed as needed to expel gas into the body of water W through the port 163. Operation of the gas generator 167 and the valves 164A, 164B can be controlled by the controller 107.

In some embodiments, the gas generator includes a mixer and a supply or supplies of one or more gas generation substances that can generate a gas when mixed with one another or with water. The gas generator may additionally or instead include a converter unit that can convert a liquid or gas at least partly into a gas, such as by catalysis or by providing energy. The gas generator may additionally or instead include a container containing a compressed gas that can selectively release the gas. According to some embodiments, the buoyancy control system 160 includes a buoyancy control system as disclosed in U.S. patent application Ser. No. 12/315,760, filed Dec. 5, 2008, the disclosure of which is incorporated herein by reference.

In some cases, the controller 107 comprises a sensor, such as a depth sensor or other means of detecting change in depth, pressure, or amount of water in the tank 162. In some cases, the controller 107 can control the actuator and/or the alter amount of water in the tank 162 in response to sensor output.

The buoyancy control system 160 is exemplary and other suitable mechanisms or systems may be used to selectively control and change the location of the center of buoyancy C and the vehicle's net buoyancy may be employed. According to some embodiments, the buoyancy control system includes a liquid- and/or gas-containing chamber that is movable along the longitudinal axis L-L to change the location of the center of buoyancy C along the longitudinal axis L-L. According to some embodiments, the liquid- and/or gas-containing chamber is the flood tank having a changeable gas volume. That is, the buoyancy of the flood tank can be altered and also the position of the flood tank along the longitudinal axis L-L can be changed. Other types of active mechanisms may be used to selectively change the vehicle buoyancy in place of or in addition to the gas generator, such as a pump. As a further alternative, the buoyancy control system can include a mechanism selectively operable to change the volume of the vehicle 100 to alter its net buoyancy or buoyancy distribution.

The payload 105 may be provided as a module and may include components for vehicle guiding/navigating, sensing, communicating, operating, causing, neutralizing, marking, material-providing, and/or mass-altering, for example. In some cases, the payload 105 includes a deployable device, such as an acoustic communication node or a sonar or other sensor array. In some cases, the deployable device includes a receiver that can receive energy and/or data conducted from the vehicle 100. In some cases, the payload includes a payload battery and a payload memory for storing products of receiving, and a receiver connector, which can be of any type that can receive a submersible connector.

The payload 105 may include one or more sensors or sensing devices or modules operative to sense one or more desired parameters, conditions and/or events. According to some embodiments, the sensor payload 105 is mounted on and/or in the front portion 112. The payload may include an environmental sensor of any type that can provide desirable data, which may include a physical, chemical, biological and/or radiological sensor. Examples of physical sensors include conductivity, temperature, depth, sound/acoustic, pressure, vibration, turbulence, luminescence, turbidity, electrical and optical/light sensors. Chemical sensors can include pH, oxygen, and composition sensors, for example. Biological sensors can include bioluminescence, fluorescence, chlorophyll presence or concentration, toxicant, and species specific sensors, for example. Radiation sensors may be of any suitable type operative to detect ionizing or non-ionizing radiation.

The payload 105 may include a guidance module or system. The guidance system may include a guidance system as disclosed in Applicant's U.S. Published Patent Application No. US-2008-0239874-A1, published on Oct. 2, 2008, titled "Underwater Guidance Systems, Unmanned Underwater Vehicles and Methods," the disclosure of which is incorporated herein by reference.

The propulsion system 120 (FIG. 2) may include a motor 122 and a propeller 124 or the like connected to the motor to be driven thereby. The motor 122 may be an electric motor, for example. The propulsion system 120 should provide adequate thrust to drive the vehicle 100 in submerged transit. The propulsion system 120 can include a steering mechanism 125 such as adjustable, driven control fins 126, an articulated propulsor, or the like. Other types or configurations of propulsion and steering mechanisms may be employed.

Operations of the vehicle 100 and the system 10 will now be described, followed by descriptions of more particular embodiments of the invention.

Navigation or transit of the vehicle 100 can be provided by the propulsion system 120, which controllably propels the vehicle body 102. The propulsion system 120 propels the vehicle 100 in the forward travel direction +X. During transit, the controller 107 maintains the hull 110 in the transit position as shown in FIG. 2 and in dashed lines in FIG. 1. According to some embodiments, when the hull 110 is in the transit position, the longitudinal axis L-L is substantially horizontal.

It may thereafter become desirable to provide communication between the vehicle 100 and other units (e.g., the satellite 20 and/or the vessel 25) using airborne signals or it may be desirable to sense other airborne signals using the antenna 103A. At this time, the antenna positioning system 140 actuates the mass redistribution system 150, the buoyancy control system 160, and/or the propulsion system 120 as needed to reorient the hull 110 from the transit position to a signal position as shown in FIG. 2 in solid lines.

In the signal position, the forward portion 112 of the hull 110 is located vertically higher above the rearward portion 114 than when in the transit position. According to some embodiments, when the hull 110 is in the signal position, the longitudinal axis L-L is substantially vertical (the vertical axis V-V is indicated in FIG. 1). In the signal position, the forward portion 112 projects above the top surface T so that the forward portion 112 (including the nose 112A) is exposed to the air A. More particularly, according to some embodiments, in the signal position, the antenna 103A is located above the top surface T.

With the forward portion 112 and the antenna 103A positioned above the top surface T, the antenna 103A can emit and/or receive signals 30 through the air A without obstruction by the water W.

The antenna positioning system 140 may cause the hull 110 to float or hover in the signal position and thereafter again descend and re-assume the fully submerged transit position (e.g., substantially horizontal). The vehicle 100 may then again transit to a new location in the body of water W.

According to some embodiments, when the vehicle 100 is in the signal position, the center of mass CM and the center of buoyancy CB are spatially related such that the vehicle 100 will maintain a substantially vertical orientation while at rest. The vehicle 100 may otherwise move vertically while oriented in this manner.

According to some embodiments, when in the signal position, the vehicle 100 has a nose-light trim, meaning the vehicle has a positive net buoyancy and a center of buoyancy CB forward of the center of gravity CG. In this case, the vehicle 100 may be returned to the fully submerged transit position by controlling the buoyancy control system 160 to reduce the vehicle's net buoyancy and/or by operating the propulsion system 120 to back the vehicle downward (i.e., to provide back-down thrust in the rearward direction). In some cases, the nose-light vehicle 100 transitions from the transit position to the signal position by turning off the thrust from the propulsion system 120 and/or turning toward vertical to project the nose 112A above the water surface.

According to some embodiments, when in the signal position, the vehicle 100 has a tail-heavy trim, meaning the vehicle 100 has a negative net buoyancy and a center of buoyancy CB forward of the center of gravity CG. In this case, the vehicle 100 may be maintained hovering with the forward portion 112 over the water top surface T by operating the propulsion system 120 to provide a sufficient forward (i.e., upward) thrust. The vehicle 100 may be returned to the fully submerged transit position by reducing or reversing the thrust from the propulsion system 120. In some cases, the vehicle 100 is transitioned from the transit position to the signal position by turning the hull 110 toward vertical using the steering system 125 and providing thrust from the propulsion system 120 as needed to achieve the desired extent of projection of the nose 112A above the water surface T. The amount of thrust provided by the propulsion system 120 may be controlled by the controller 107 responsive to a signal (e.g., a water depth signal from a depth sensor representing the depth of the hull 110 in the water W).

Figure 3:
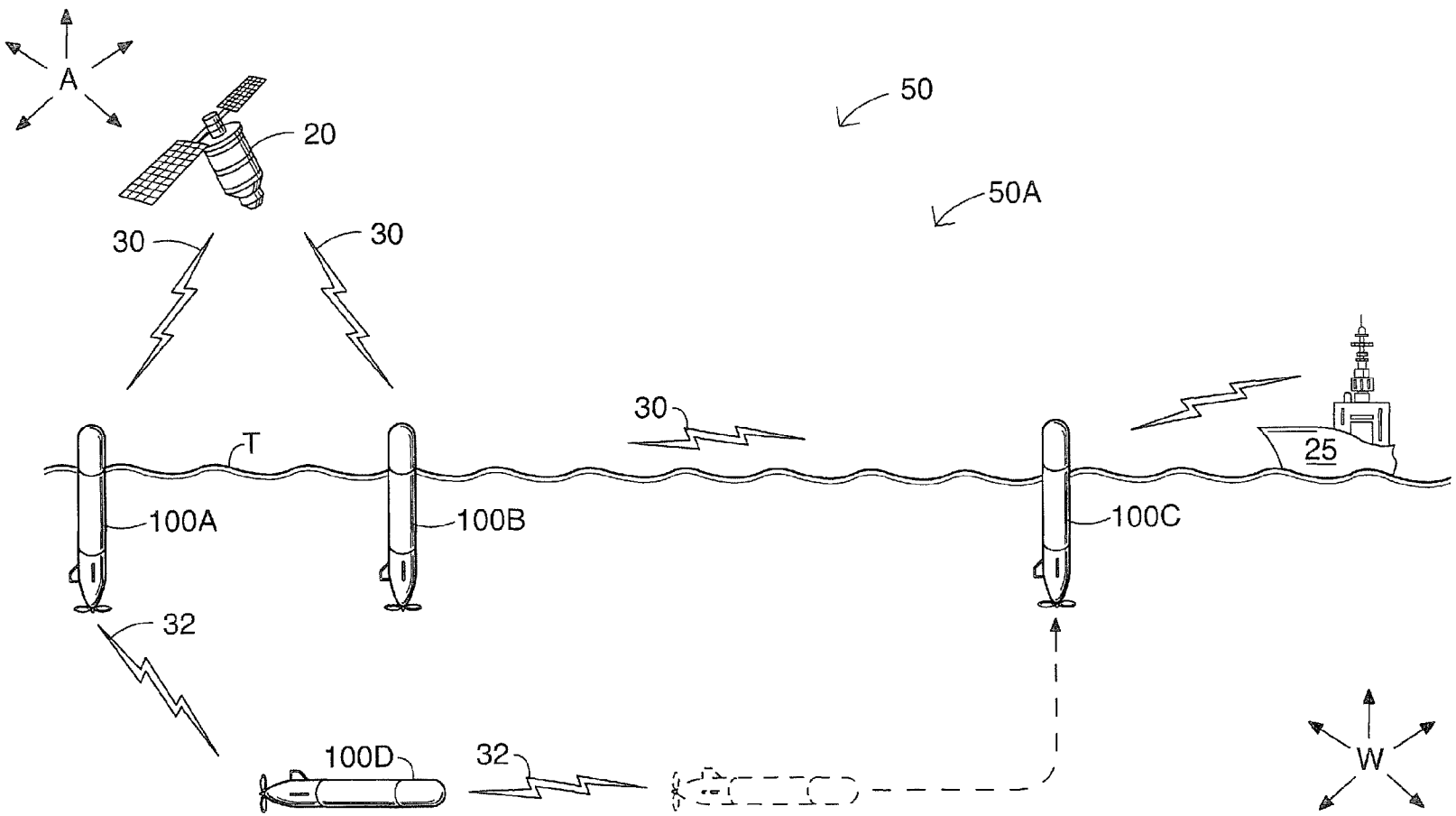
FIG. 3 is a schematic view of a communications system and network including a plurality of the vehicles of FIG. 1.

According to some embodiments, the vehicle 100 is used as a node for sensing or communicating (SOC) at one or more locations in the body of water W. For example, with reference to FIG. 3, one or more of the unmanned submersible vehicles 100A-D as disclosed herein may be used as points or nodes in a communications system 50 defining a communications network 50A. Each vehicle 100A-D can operate at desired locations to collect signals and communicate across the network 50A by any suitable means or method (e.g., ad hoc, asynchronous, sequential, coordinated or coherent).

In the network 50A, the vehicles 100A-D may communicate using airborne signals 30 and/or aquatic or waterborne signals 32. Waterborne signals may include sonar or projected light signals, for example. In order to receive or emit airborne signals 30, the vehicles 100A-D can assume the signal position as shown with respect to the vehicles 100A, 100B, 100C (in solid lines). Such airborne signals may be transmitted between respective vehicles (e.g., between the vehicles 100B and 100C, as illustrated) and/or between the vehicles 100A-D and secondary nodes (e.g., the satellite 20 and the vessel 25, as illustrated). Waterborne signals 32 can be transmitted between fully submerged vehicles (e.g., the vehicles 100D and 100C (in dashed lines) or between a fully submerged vehicle and a vehicle in the signal position (e.g., the vehicles 100D and 100A). In some cases, one or more of the vehicles 100A-D detects waterborne signals (which may or may not be communications signals) or conditions and relays or communicates these signals or conditions (or corresponding data) to one or more other network nodes via airborne signals from the signal position.

In some methods and as illustrated by the vehicle 100C, one or more of the vehicles transit from one location to another while submerged in the transit position and then transition to the signal position in order to sense or emit airborne signals. The vehicle 100C may thereafter drop again to its submerged transit position, transit to a new location, and resurface at the new location in the signal position.

Sensing by the vehicle 100 may include detecting, receiving, conditioning, sampling, altering, processing, classifying, identifying, recording, storing, and/or event triggering. In some cases, the vehicle 100 trigger responds to a detected signal by executing a prescribed action such as emitting a communication signal and/or submerging.

The vehicle 100 may detect waterborne signals and associated data, such as conductivity, temperature, ambient light, fluorescence, bioluminescence, pH, chlorophyll, other chemical(s), a biologic, dissolved or suspended matter, a hydrodynamic parameter, or acoustic signals. Detection of waterborne signals can be conducted at one or more depth, one or more of which may be proximate the water surface T.

According to some embodiments, when the vehicle 100 is in the signal position, a sensor (e.g., forming a part of the payload 105) is also disposed above the top surface T of the water. The vehicle 100 is thereby enabled to detect airborne signals or environmental parameters from a location proximate the water surface T. Such airborne signals and environmental parameters may include one or more physical, chemical, biologic, image, radio, electromagnetic or radiologic signals. For example, the vehicle 100 may be used to extend a radiologic sensor above the water surface T to detect radiation which would otherwise be blocked by water.

In some embodiments, airborne signals are provided to the vehicle 100 in the signal position to provide an instruction, command, or identifier representing or corresponding to a desired location for sensing or communicating. In some embodiments, the vehicle 100 navigates or transits toward the designated location by dead reckoning while submerged, for example. The vehicle 100 may surface into the signal position one or more times to detect an airborne navigation aiding localization, update or supplemental instruction signal from a remote source (such as a GPS signal or signals from one or more GPS satellites). The vehicle 100 can then re-assume its transit position and again transit toward the designated location. This cycle of surfacing to receive update or navigation signals may be executed multiple times or periodically as the vehicle progresses toward the designated location.

In some embodiments, the vehicle 100 assumes the signal position in order to transmit or broadcast airborne navigation aiding signals to one or more remote vehicles.

Various criteria or factors may be incorporated into the design of the vehicle 100. The vehicle 100 is configured to achieve a desirable net buoyancy and/or trim in order to selectively assume a vertical orientation and, more particularly, the signal position when called up. The center of mass CM and center of buoyancy CB are established at or adjustable to enable a vertical orientation. The net buoyancy may be selected responsive to mission and water properties such as density, and antenna size, weight, mounting and/or type. The trim may be selected responsive to water properties, node weight, and desired nose-light or tail-heavy configuration. The locations of the center of mass CM and center of buoyancy CB can be selected responsive to various factors such as water density, node mass, antenna type and size, and desired nose-light or tail-heavy configuration. The propulsion system 120 may be designed to provide adequate back-down or surfacing/hovering power and/or steering responsive to such factors as vehicle buoyancy, and desired speed, direction, orientation and/or depth of the vehicle 100.

The vehicle control system 107 can include a guidance navigation and control (GNC) sensor, a state sensor, an environmental sensor, and/or a processor. The GNC sensor may include a depth, altitude, speed, inclination, acceleration, roll, direction, location, inertial measurement, homing, and/or obstacle avoidance sensor. The state sensor may include a buffeting, stall, vibration, pressure, leak, power, and/or system health sensor. The processor can be any type that can process sensor signals and provide control signals to the propulsion system 120, the antenna positioning system 140, the communications system 103, and/or other systems and components of the vehicle 100.

The vehicle 100 can be used to carry a payload to a desired location. The vehicle 100 can carry one or more sensors for operations. An illustrative payload includes one or more sensors or a sensing array. In some cases, the sensor and/or array is deployable. A second illustrative payload includes a neutralization charge. A third illustrative payload is materiel for personnel. A fourth illustrative payload is a releasable device for communicating from proximate the water surface. A fifth illustrative payload includes a marker that can provide a signal, such as for navigation aiding and/or communicating.

The vehicle 100 can be navigated to establish an operating position, and may be further navigated to establish a second, subsequent operating position. In some cases, the operating position is established by settling on or, at least partly, in sediment.

The vehicle 100 may be used to conduct surveillance and/or survey in the operational area. In some cases, the vehicle 100 detects signals and/or images, water parameters, and/or events. In some cases, the vehicle 100 communicates responsive to detecting. In some cases, the vehicle 100 deposits and/or releases a payload. In some cases, the vehicle 100 operates or monitors a deposited or deployed payload. In some cases, the vehicle 100 recovers an object. In some cases, the vehicle 100 interchanges energy and/or data with a secondary object. One example is providing energy and/or data to a secondary object. In another example, the vehicle 100 retrieves data from a secondary object. In some embodiments, the secondary object includes a sensing system deployed in the substratum. In some embodiments, the secondary object includes another vehicle.

The sensor device may be used to determine a location of the vehicle 100 such as by GPS or compass reading. In some cases, the sensor device detects signals and/or water parameters. In some cases, signal detection by the sensor device includes processing signals and/or parameters according to an algorithm. In some cases, the sensor device senses signals (e.g., acoustic, optical, electrical, radiation, or magnetic) indicative of a desirably sensed construction. In some cases, the sensor device infers a location of the vehicle (e.g., from signals of opportunity). The results of detecting may be processed to classify a signal and/or its source or to provide a derived parameter such as a sound velocity, a water current profile and or a water salinity profile, for example.

In some cases, the vehicle 100 can release an aerial payload (e.g., a balloon, tethered aerostat, kite, or autonomous air vehicle) for use in sensing and/or communicating. Payload release can comprise a portion of sensing and/or communicating.

In some cases, a detected signal can be used to characterize, quantify, classify, identify or localize an object or signal source. In some cases, the vehicle 100 can be used to spoof, attack, jam or otherwise affect detected signals.

In some embodiments, at least a portion of the vehicle is deployed to communicate. The vehicle may send data reflective of location and/or results of processing. In some cases, the vehicle releases an expendable communication device such as disclosed in co-assigned U.S. patent application Ser. Nos. 11/494,941 and 11/495,134, the disclosures of which are incorporated herein by reference. In some cases, the released communications device uses a radio and/or an optical or acoustic transponder. In some cases, the vehicle receives signals such as commands, algorithm updates, or operational data.

In some cases, the vehicle 100 is recovered or scuttled after assuming the signal position. For example, the vehicle 100 can transit to a predetermined or communicated location for recovery. Or, the vehicle 100 can scuttle to avoid inadvertent recovery (e.g., by destroying its circuits or at least partial flooding to provide negative buoyancy for sinking).

Figure 4:
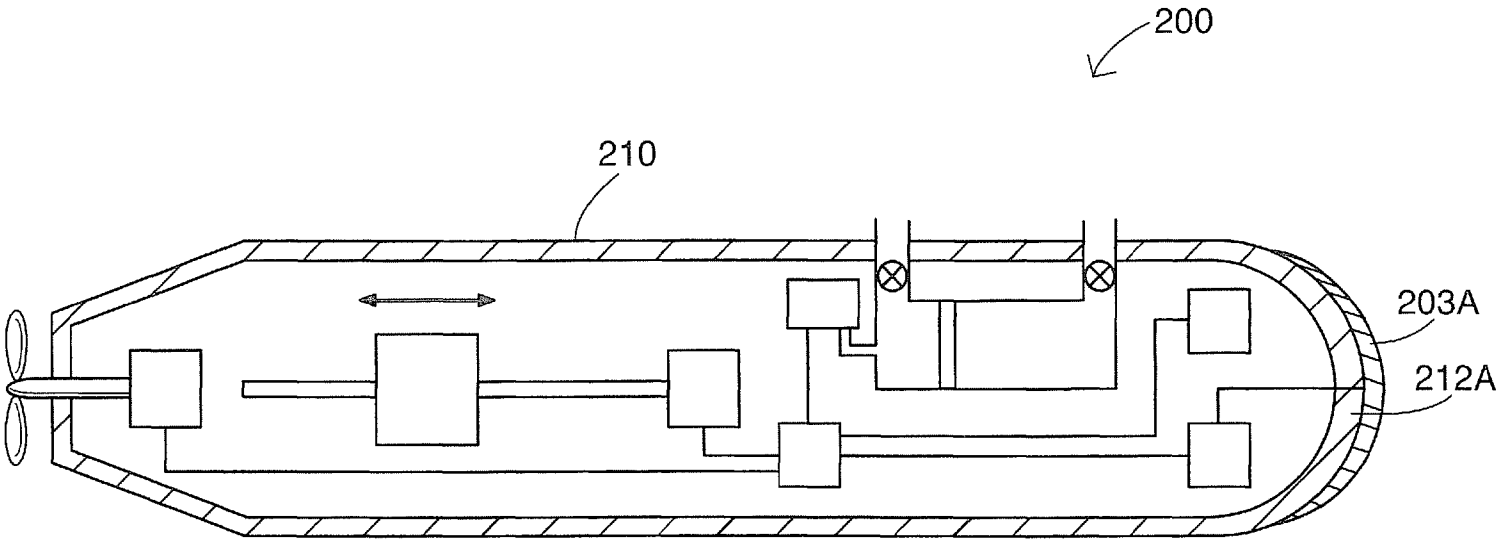
FIG. 4 is a schematic, cross-sectional view of an unmanned submersible vehicle according to further embodiments of the present invention.

The provision of the in-built antenna 103A can enable the antenna 103A to be robust against damage and fouling while making little or no substantial contribution to hydrodynamic drag on the vehicle 100. The antenna may be otherwise incorporated within or on the hull 110. According to some embodiments, the antenna is internal to, encased within, integrated with and/or embedded in the hull. According to some embodiments, the antenna is mounted conformally on the outer surface of hull such as by appliqué. For example, in FIG. 4 an unmanned submersible vehicle 200 according to embodiments of the present invention is shown having an antenna 203A bonded or otherwise secured to and conformed with the nose 212A of the hull 210. The vehicle 200 may otherwise correspond to the vehicle 100 in construction and use.

Figure 5:
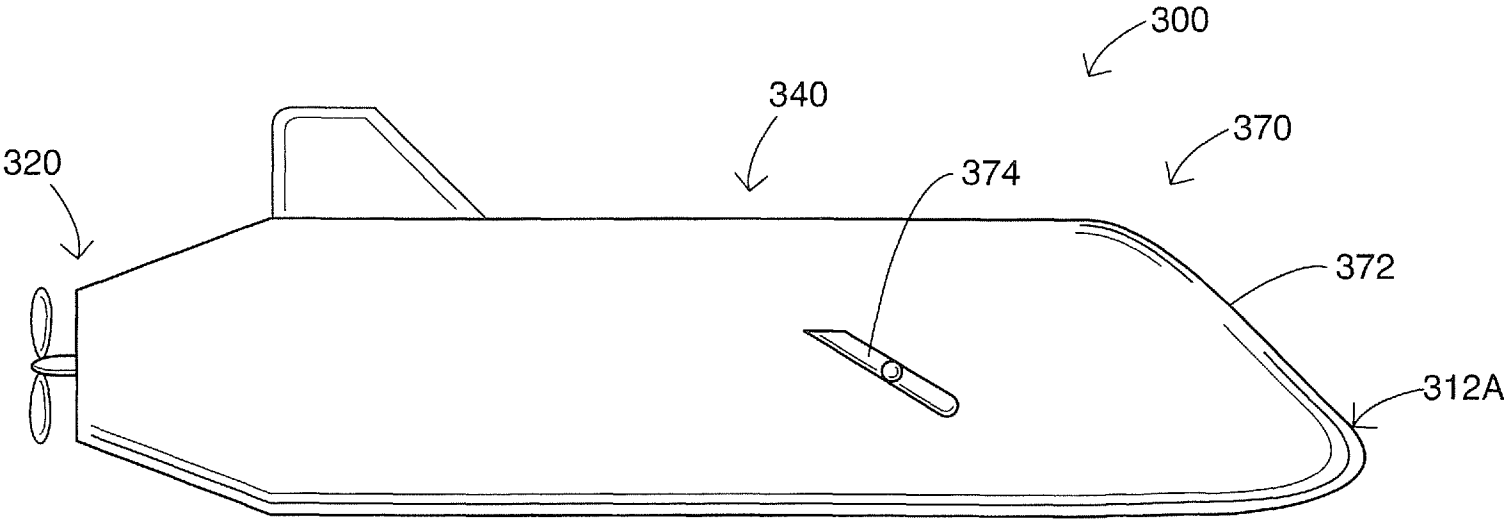
FIG. 5 is a side view of an unmanned submersible vehicle according to further embodiments of the present invention.

In addition or alternatively to the antenna positioning system mechanisms discussed above, an unmanned submersible vehicle according to some embodiments may be configured to provide dynamic control of vehicle orientation. An exemplary vehicle 300 is shown in FIG. 5 and corresponds to the vehicle 100 except as follows. The vehicle 300 includes an antenna positioning system 340 comprising a propulsion system 320 and a dynamic control system 370. The propulsion system 320 may correspond to the propulsion system 120. The dynamic control system 370 includes one or more means of providing pitch moments such as an inclined surface 372 or a dive plane 374. In transit, under the influence of forward thrust from the propulsion system 320, the control surfaces 372, 374 provide a pitching moment that holds the nose 312A down (or the hull tail up). When the transiting vehicle 300 is slowed or the angle of the control surface is changed (e.g., the ailerons 374 are rotated), the vehicle 300 will tend to tilt upwardly to the vertical orientation and the signal position. This effect may be used to replace or supplement the aforementioned mechanisms for altering the magnitudes or positions of the vehicle center of mass CM, center of buoyancy CB, or net buoyancy.

While certain mechanisms have been described and illustrated herein for selectively altering the buoyancy and trim of the vehicle, other types or configurations may be employed to displace a weight or a float to provide change of buoyancy or trim in accordance with further embodiments. Furthermore, in some embodiments, the vehicle may be adapted to selectively transition between and place the hull in each of the transit position and the signal position as described herein by means of its propulsion and steering system and the mass redistribution and/or buoyancy control system may be omitted.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. An unmanned submersible vehicle for use in a body of liquid having a top surface and in air overlying the top surface, the vehicle comprising:

a hull having first and second opposed ends, the hull including a first hull portion adjacent the first end and a second hull portion adjacent the second end, wherein the hull is elongated and defines a longitudinal axis;

an integral antenna disposed within the first hull portion;

a mass distribution system including a mass member within the hull, the mass distribution system being operable to move the mass member along the longitudinal axis away from and toward the antenna; and an antenna positioning system configured to reorient the hull from a transit position to a signal position, wherein, when the hull is in the signal position:

the first hull portion and the antenna are disposed above the second hull portion a greater vertical distance than when the hull is in the transit position;

the first hull portion and the antenna are disposed above the top surface and in the air while at least the second hull portion remains submerged in the body of liquid; and the antenna is disposed entirely in the hull and is operative to emit signals through the air above the top surface without obstruction by the body of liquid and/or to receive signals through the air above the top surface without obstruction by the body of liquid, wherein the signals are emitted and/or received by the antenna within the hull.

2. The vehicle of claim 1 wherein:

the vehicle has a center of buoyancy (CB) and a center of mass (CM);

the antenna positioning system is configured to reorient the hull from the transit position to the signal position by changing pitching moments tending to counteract CB and CM-induced moments during transit, changing the buoyancy of the vehicle and/or altering the position of at least one of the CB and the CM; and when the hull is in the signal position, the CB is located vertically above the CM.

3. The vehicle of claim 2 the antenna positioning system is configured to reorient the hull by altering the relative positions of the CB and the CM within the hull.

4. The vehicle of claim 2 wherein the antenna positioning system is configured to reorient the hull by altering the position of at least one of the CB and the CM with respect to the hull.

5. The vehicle of claim 2 wherein the antenna positioning system is configured to reorient the hull by altering the buoyancy of the vehicle.

6. The vehicle of claim 5 including a flood tank, wherein the antenna positioning system is configured to reorient the hull from the transit position to the signal position by altering an amount of the liquid from the body of liquid in the flood tank to thereby controllably alter the buoyancy of the vehicle.

7. The vehicle of claim 2 wherein the antenna positioning system is configured to reorient the hull by changing a pitching moment.

8. The vehicle of claim 1 including a propulsion system to forcibly and controllably drive and steer the vehicle through the body of liquid in the transit position and/or down into the body of liquid from the signal position to fully submerge the hull in the body of liquid.

9. The vehicle of claim 1 including a sensing device mounted on and/or in the hull to sense a parameter external to the vehicle.

10. The vehicle of claim 1 including a communications device operably connected to the antenna to generate and/or receive and process signals propagated through the air over the top surface.

11. The vehicle of claim 1 wherein:

the longitudinal axis is substantially horizontal when the hull is in the transit position; and the longitudinal axis is substantially vertical when the hull is in the signal position.

12. The vehicle of claim 1 wherein the vehicle is not tethered to another object.

13. The vehicle of claim 12 including a propulsion system to forcibly and controllably drive and steer the vehicle through the body of liquid in the transit position and/or down into the body of liquid from the signal position to fully submerge the hull in the body of liquid.

14. The vehicle of claim 1 wherein the signals are radio waves.

15. A communications system for use in a body of liquid having a top surface and in air overlying the top surface, the communications system comprising:

a plurality of unmanned submersible vehicles adapted to be distributed in the body of liquid, each of the vehicles including:

a hull having first and second opposed ends, the hull including a first hull portion adjacent the first end and a second hull portion adjacent the second end, wherein the hull is elongated and defines a longitudinal axis;

an integral antenna disposed within the first hull portion;

a mass distribution system including a mass member within the hull, the mass distribution system being operable to move the mass member along the longitudinal axis away from and toward the antenna;

an antenna positioning system configured to reorient the hull from a transit position to a signal position, wherein, when the hull is in the signal position:

the first hull portion and the antenna are disposed above the second hull portion a greater vertical distance than when the hull is in the transit position;

the first hull portion and the antenna are disposed above the top surface and in the air while at least the second hull portion remains submerged in the body of liquid; and the antenna is disposed entirely in the hull and is operative to emit signals through the air above the top surface without obstruction by the body of liquid and/or to receive signals through the air above the top surface without obstruction by the body of liquid, wherein the signals are emitted and/or received by the antenna within the hull; and a communications device operably connected to the antenna to generate and/or receive and process signals propagated through the air over the top surface.

16. A method for operating an unmanned submersible vehicle, the method comprising:

providing an unmanned submersible vehicle for use in a body of liquid having a top surface and in air overlying the top surface, the vehicle including:

a hull having first and second opposed ends, the hull including a first hull portion adjacent the first end and a second hull portion adjacent the second end, wherein the hull is elongated and defines a longitudinal axis;

an integral antenna disposed within the first hull portion;

a mass distribution system including a mass member within the hull, the mass distribution system being operable to move the mass member along the longitudinal axis away from and toward the antenna;

an antenna positioning system configured to reorient the hull from a transit position to a signal position; and using the antenna positioning system, reorienting the hull from a transit position to a signal position, wherein, when the hull is in the signal position:

the first hull portion and the antenna are disposed above the second hull portion a greater vertical distance than when the hull is in the transit position;

the first hull portion and the antenna are disposed above the top surface and in the air while at least the second hull portion remains submerged in the body of liquid; and the antenna is disposed entirely in the hull and is operative to emit signals through the air above the top surface without obstruction by the body of liquid and/or to receive signals through the air above the top surface without obstruction by the body of liquid, wherein the signals are emitted and/or received by the antenna within the hull.

17. The method of claim 16 including reorienting the hull from the transit position to the signal position by changing pitching moments tending to counteract CB and CM-induced moments during transit, changing the buoyancy of the vehicle and/or altering the position of at least one of the CB and the CM, wherein, when the hull is in the signal position, the CB is located vertically above the CM.

18. The method of claim 17 including reorienting the hull from the transit position to the signal position by altering the relative positions of the CB and the CM within the hull.

19. The method of claim 17 including reorienting the hull from the transit position to the signal position by altering the position of at least one of the CB and the CM with respect to the hull.

20. The method of claim 17 including reorienting the hull from the transit position to the signal position by altering the buoyancy of the vehicle.

21. The method of claim 16 wherein the vehicle includes a propulsion system and including forcibly and controllably driving and steering the vehicle through the body of liquid in the transit position using the propulsion system.

22. The method of claim 16 wherein the vehicle includes a propulsor and including forcibly driving the vehicle down into the body of liquid from the signal position using the propulsor to fully submerge the hull in the body of liquid.

23. The method of claim 16 including sensing a parameter external to the vehicle using a sensing device mounted on and/or in the hull.

24. The method of claim 16 including generating and/or receiving and processing signals propagated through the air over the top surface using a communications device operably connected to the antenna.

25. The method of claim 16 including propelling the vehicle through the body of water in a fully submerged condition while in the transit position, wherein:

the longitudinal axis is substantially horizontal when the hull is in the transit position; and the longitudinal axis is substantially vertical when the hull is in the signal position.

26. The method of claim 16 wherein the vehicle is not tethered to another object.

27. The method of claim 26 wherein the vehicle includes a propulsion system and including forcibly and controllably driving and steering the vehicle through the body of liquid in the transit position using the propulsion system.

28. A method for operating an unmanned submersible vehicle, the method comprising:

providing an unmanned submersible vehicle for use in a body of liquid having a top surface and in air overlying the top surface, the vehicle including:

a hull having first and second opposed ends, the hull including a first hull portion adjacent the first end and a second hull portion adjacent the second end, wherein the hull is elongated and defines a longitudinal axis;

an integral antenna disposed within and/or mounted on the first hull portion;

an antenna positioning system configured to reorient the hull from a transit position to a signal position, the antenna positioning system comprising a propulsion system, a mass distribution system, and a buoyancy control system, wherein:

the propulsion system includes a propulsor, the propulsion system being operable to actively displace fluid to drive the vehicle through the body of liquid;

the mass distribution system includes a mass member within the hull, the mass distribution system being operable to move the mass member along the longitudinal axis away from and toward the antenna; and the buoyancy control system is operable to alter the net buoyancy of the vehicle between a minimum buoyancy and a maximum buoyancy;

using the buoyancy control system, maintaining the vehicle submerged in the transit position and, with the vehicle in the submerged transit position, driving the vehicle in the body of liquid using the propulsion system; and using the antenna positioning system, reorienting the hull from the transit position to the signal position, wherein, when the hull is in the signal position:

the first hull portion and the antenna are disposed above the second hull portion a greater vertical distance than when the hull is in the transit position;

the first hull portion and the antenna are disposed above the top surface and in the air while at least the second hull portion remains submerged in the body of liquid; and the antenna is operative to emit signals through the air above the top surface and/or to receive signals through the air above the top surface;

wherein reorienting the hull from the transit position to the signal position includes:

using the buoyancy control system, increasing the net buoyancy of the vehicle to substantially the maximum buoyancy to cause the vehicle to ascend; and using the mass distribution system, moving the mass member longitudinally to a distal position away from the antenna, thereby shifting the center of mass of the vehicle away from the antenna.

29. The method of claim 28, including:

after reorienting the hull from the transit position to the signal position, using the antenna positioning system to reorient the hull from the signal position to the transit position, including:

using the buoyancy control system, decreasing the net buoyancy of the vehicle to less than the maximum buoyancy to cause the vehicle to descend; and using the mass distribution system, moving the mass member longitudinally away from the distal position and toward the antenna, thereby shifting the center of mass of the vehicle toward the antenna; then using the buoyancy control system, maintaining the vehicle submerged in the transit position and, with the vehicle in the submerged transit position, driving the vehicle in the body of liquid using the propulsion system; and then using the antenna positioning system, reorienting the hull from the transit position to the signal position, wherein reorienting the hull from a transit position to a signal position includes:

using the buoyancy control system, increasing the net buoyancy of the vehicle to substantially the maximum buoyancy to cause the vehicle to ascend; and using the mass distribution system, moving the mass member to the distal position away from the antenna, thereby shifting the center of mass of the vehicle away from the antenna.

30. The method of claim 28 wherein, in the signal position, the antenna is disposed entirely in the hull and is operative to emit signals through the air above the top surface without obstruction by the body of liquid and/or to receive signals through the air above the top surface without obstruction by the body of liquid.

* * * * *

UNITED STATES PATENT AND TRADEMARK OFFICE

CERTIFICATE OF CORRECTION

PATENT NO. : 8,418,642 B2
APPLICATION NO. : 12/437181
DATED : April 16, 2013
INVENTOR(S) : Vosburgh It is certified that error appears in the above-identified patent and that said Letters Patent is hereby corrected as shown below:

In the Claims:

Column 13, Claim 3, Line 29: Please correct "claim 2 the antenna"
to read -- claim 2 wherein the antenna --

Signed and Sealed this
Thirteenth Day of May, 2014

Michelle K. Lee

Michelle K. Lee
*Deputy Director of the United States Patent and Trademark Office*